US005435670A

United States Patent [19]

Pienaar et al.

[11] Patent Number: 5,435,670

[45] Date of Patent: Jul. 25, 1995

[54] SPACER ASSEMBLY AND METHOD

[75] Inventors: Frans R. P. Pienaar; Richard G. King, both of Transvaal, South Africa

[73] Assignee: HL&H Timber Products (Proprietary) Limited, Transvaal, South Africa

[21] Appl. No.: 104,796

[22] Filed: Aug. 11, 1993

[51] Int. Cl.[6] ..... E21D 15/00

[52] U.S. Cl. ..... 405/289; 405/288

[58] Field of Search ..... 405/288, 289, 290; 248/351, 354.1, 354.2, 357

[56] References Cited

U.S. PATENT DOCUMENTS

| | | | |
|---|---|---|---|
| 1,735,974 | 11/1929 | O'Toole | 405/288 X |
| 4,628,658 | 12/1986 | Erasmus | 405/288 X |
| 5,308,196 | 5/1994 | Frederick | 405/288 |

FOREIGN PATENT DOCUMENTS

| | | |
|---|---|---|
| 676272 | 10/1968 | South Africa . |
| 781895 | 3/1978 | South Africa . |
| 780570 | 2/1979 | South Africa . |
| 816235 | 9/1981 | South Africa . |
| 822418 | 4/1982 | South Africa . |
| 835295 | 7/1983 | South Africa . |
| 841848 | 3/1984 | South Africa . |
| 843333 | 5/1984 | South Africa . |
| 844219 | 6/1984 | South Africa . |
| 846448 | 8/1984 | South Africa . |
| 851042 | 2/1985 | South Africa . |
| 854105 | 5/1985 | South Africa . |
| 862467 | 4/1986 | South Africa . |
| 866423 | 8/1986 | South Africa . |
| 867180 | 9/1986 | South Africa . |
| 867181 | 9/1986 | South Africa . |
| 870462 | 1/1987 | South Africa . |
| 870767 | 2/1987 | South Africa . |
| 882575 | 4/1988 | South Africa . |
| 882701 | 4/1988 | South Africa . |
| 893960 | 3/1989 | South Africa . |
| 905261 | 7/1990 | South Africa . |
| 906324 | 8/1990 | South Africa . |
| 911473 | 2/1991 | South Africa . |
| 911474 | 2/1991 | South Africa . |
| 911862 | 3/1991 | South Africa . |
| 912929 | 4/1991 | South Africa . |
| 921272 | 2/1992 | South Africa . |
| 925125 | 7/1992 | South Africa . |
| 925255 | 7/1992 | South Africa . |
| 928813 | 11/1992 | South Africa . |
| 928814 | 11/1992 | South Africa . |
| 928815 | 11/1992 | South Africa . |
| 929126 | 11/1992 | South Africa . |

*Primary Examiner*—David H. Corbin
*Attorney, Agent, or Firm*—Morgan & Finnegan

[57] ABSTRACT

The invention concerns a method and apparatus for providing yielding support for a hanging wall above a footwall in a mine working. A support assembly is installed between the hanging wall and the footwall, the assembly including a spacer (10), a pack (30) and a grout-inflatable bag (32). Grout is pumped into the bag (32) and is allowed to set to apply a vertical prestess force to the support assembly. The spacer (10) is substantially stiffer in compression than the pack (30), which is designed to yield under the compressive loading applied by the hanging wall. The use of a stiff spacer (10) serves to elevate the yielding pack to a suitble operative height without the allowable slenderness ratio for the pack to be exceeded.

8 Claims, 2 Drawing Sheets

SPACER ASSEMBLY AND METHOD

FIELD OF THE INVENTION

THIS invention relates to a support assembly and method to be used in a mine working to support a hanging wall above a footwall.

In coal mines, it is conventional to carry out mining according to the well-known board and pillar system. In this system, support for the hanging wall is provided by substantial pillars which are left in place, with ore removal taking place between the pillars. The pillars themselves contain substantial amounts of coal which is not removed in the mining process and this is considered wasteful.

SUMMARY OF THE INVENTION

A first aspect of the invention provides a method of providing yielding support for a hanging wall above a footwall in a mine working, the method comprising the steps of installing, between the hanging and footwalls, a support assembly which includes:

- a spacer comprising an assembly of timber members arranged in relation to one another to produce a structure with a relatively high level of stiffness in the vertical direction; and
- a pack mounted upon or beneath the spacer, the pack comprising timber members arranged in relation to one another to produce a pack which has a relatively low level of stiffness in the vertical direction and which is vertically yieldable under compressive loading applied thereto when the hanging wall closes towards the footwall in the mine working.

The method preferably includes the further step of incorporating, within the height of the support assembly, a prestressing means capable of placing the assembly under a prestress force. In a typical embodiment, the pack is mounted upon the spacer, a grout-inflatable bag is located between between the pack and the hanging wall, and the bag is inflated with a settable grout to apply a predetermined prestress force to the support assembly.

The invention contemplates various different types of spacer. In some cases, the spacer includes a series of elongate timber members arranged side-by-side in a cluster, with the timber grain of the timber members extending in a direction transverse to the hanging wall and the footwall. In other cases, the spacer is formed by laying a series of layers one on top of the other, each layer including a plurality of elongate timber members arranged with their timber grain horizontal and a plurality of timber blocks arranged with their timber grain vertical, the arrangement of layers one on top of the other being such that at least some of the timber blocks bear directly on timber blocks of the layer immediately below.

A second aspect of the invention provides a support assembly for supporting a hanging wall in yieldable fashion above a footwall in a mine working, the support assembly comprising:

- a spacer comprising an assembly of timber members arranged in relation to one another to produce a structure with a relatively high level of stiffness in the vertical direction; and
- a pack mounted upon or beneath the spacer, the pack comprising timber members arranged in relation to one another to produce a pack which has a relatively low level of stiffness in the vertical direction and which is vertically yieldable under compressive loading applied thereto when the hanging wall closes towards the footwall in the mine working.

BRIEF DESCRIPTION OF THE DRAWINGS

The invention will now be described in more detail, by way of example only, with reference to the accompanying drawings in which:

FIG. 2 is employed to provide for yielding;

DESCRIPTION OF EMBODIMENTS

Figure 1:
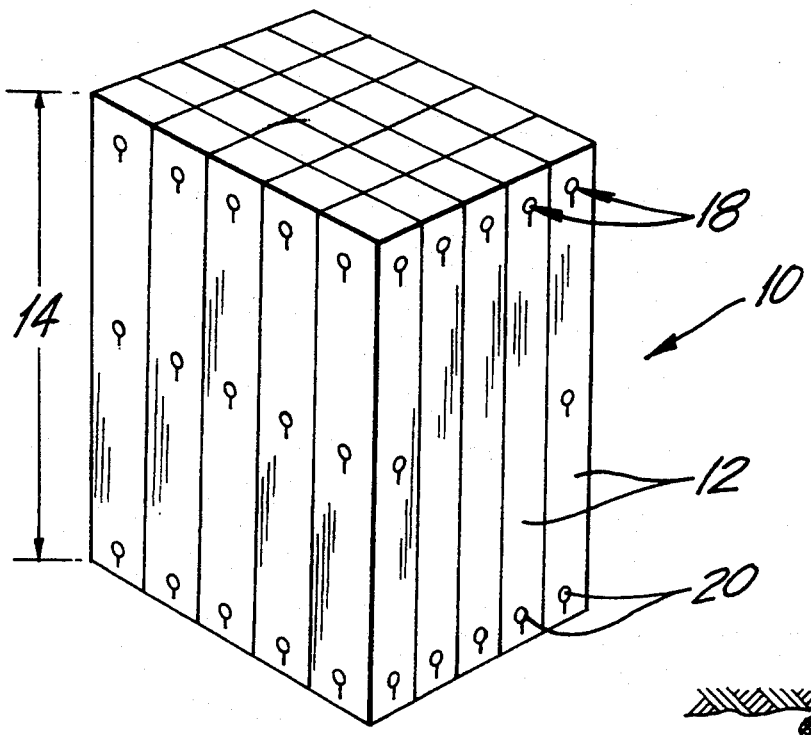
FIG. 1 shows a perspective view of one version of spacer for use in a support assembly of the invention.

FIG. 1 shows a spacer 10 which is in the form of a cluster of interconnected timber slabs 12. Each timber slab has a length 14, in the direction of its timber grain, which is substantially greater than its transverse dimension. Each timber slab 12 is machined to have a rectangular transverse cross-section, but it should be appreciated that other cross-sectional shapes may be used in other embodiments.

In the spacer 10, the timber slabs 12 are located side by side to form a compact rectangular cluster. In the illustrated case, the individual timber slabs are interconnected with one another by means of spun-drilled wires 18. In each case, this is achieved by chucking a sharpened wire in a drill, rotating the wire to cause it to drill through the cluster of timber slabs, unchucking the wire and finally bending over its protruding ends 20 on opposite sides of the cluster.

Other interconnection techniques, such as plain nailing or strapping could also be used instead of spin-drilling.

The spacer 10 of FIG. 1 is used in an underground mine working, typically in a coal or other soft rock mine, as part of a support assembly of the invention. In practice, the spacer 10 may be assembled on surface and then transported, as a unit, to the underground location where it is to be installed. Alternatively, the spacer may be constructed underground. Although specific mention is made of a soft rock mine, it is believed that the spacer could also find application in hard rock mines, such as gold or platinum mines.

In use, the spacer 10 is arranged upright, i.e. at the illustrated orientation, on the footwall. A yieldable support, in the form of a timber-based pack 30 (FIG. 3) is then located or assembled on top of the spacer 10, between the upper extremity of the spacer 10 and the hanging wall. The pack is typically a HERCULES-type pack of the kind designed and supplied by the present applicant, but various other types of timber-based packs may also be used, depending on the expected loading that the hanging wall will apply.

The height of the spacer 10 and of the pack 30 are chosen, in relation to the width of the mine working, i.e. the clear vertical distance between the hanging wall and the footwall, so that a gap exists between the upper surface of the pack and the hanging wall. A grout-inflatable bag 32, typically of the PACKSETTER (trade mark) type supplied by the present applicant, is then located in this gap, on top of the pack. The bag is inflated under pressure with a settable grout, typically of the type supplied for conventional PACKSETTER applications.

Figure 3:
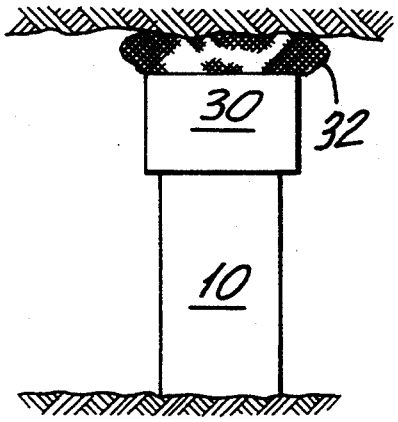
FIG. 3 shows a side view of a support assembly of the invention in which a spacer according to FIG. 1

The bag expands vertically into contact with the hanging wall. The supply pressure is chosen so that a predetermined vertical prestressing force is applied to the support assembly, and the grout is then allowed to set in the bag. The existence of the initially applied prestressing force on the assembly of spacer 10 and pack 30 renders the assembly immediately capable of restraining collapse of the hanging wall. In FIG. 3, the spacer 10, pack 30 and bag 32 form a support assembly of the invention.

The HERCULES or other type of pack which is installed on top of the spacer 10 is yieldable in nature. Thus as the hanging wall closes on the footwall with passage of time, the pack is able to yield vertically to accommodate such closure, without the support assembly "punching" into the hanging wall. The pack 30 will in each case be designed to yield in a controlled manner under the compressive loading which is expected in a particular mine working.

It will be appreciated that the spacer 10, in which the timber grain is vertical, will be far stronger in compression than the pack 30 which will include laterally orientated timber members. Thus yielding will take place primarily in the pack, with the spacer 10 yielding very little if at all. Thus in practice the spacer 10 serves merely to elevate the pack 30 to the appropriate height above the footwall.

Figure 2:
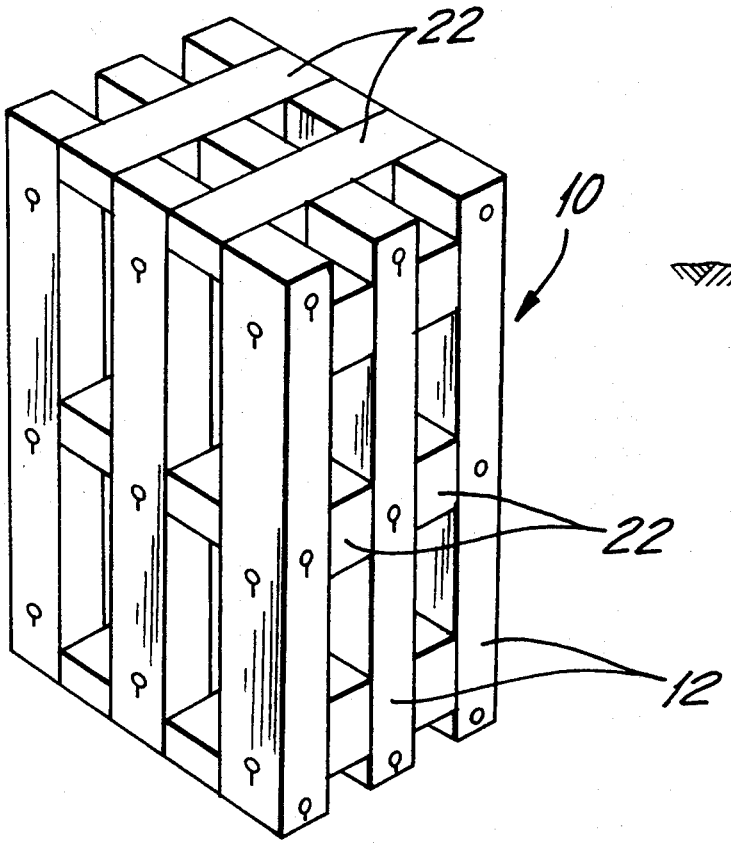
FIG. 2 shows a perspective view of another version of spacer for use in a support assembly of the invention.

In FIG. 2, components corresponding to those seen in FIG. 1 are designated with the same reference numerals. In this case, the timber slabs 12 are not arranged compactly in side by side relationship, but are spaced apart by rectangular timber spacer blocks 22. The slabs and timber spacer blocks are fastened together to form the spacer 10 using a spin-drilling or other conventional fastening technique. The spacer 10 of in FIG. 2 is used in exactly the same way as the spacer 10 of FIG. 1.

The combination of spacer 10 and pack 30 creates a support structure of considerable height, with the pack itself having a height that is not excessively high in relation to its lateral dimensions.

Experience has shown that timber-based pack structures should not exceed certain height to width, i.e. slenderness, ratios if they are to maintain adequate stability when placed under compressive load by the hanging wall. The provision of a relatively incompressible spacer enables a pack to be used which has a safe slenderness ratio.

Specific mention has been made of a support assembly in which the pack is located atop the spacer and in which a grout-inflatable bag is interposed between the pack and the hanging wall. In other embodiments (not illustrated), the yieldable pack could be placed on the footwall with the spacer on top of the pack and the bag between the spacer and the hanging wall. Alternatively, the bag could be interposed between the spacer and pack.

As yet another alternative where substantial prestressing of the support assembly is not required, the bag 32 can be omitted entirely. In this case, suitable wedges or other small spacers could be hammered into position between the hanging wall and the top of the pack 30 (or spacer 10) to locate the assembly firmly in position.

Figure 4:
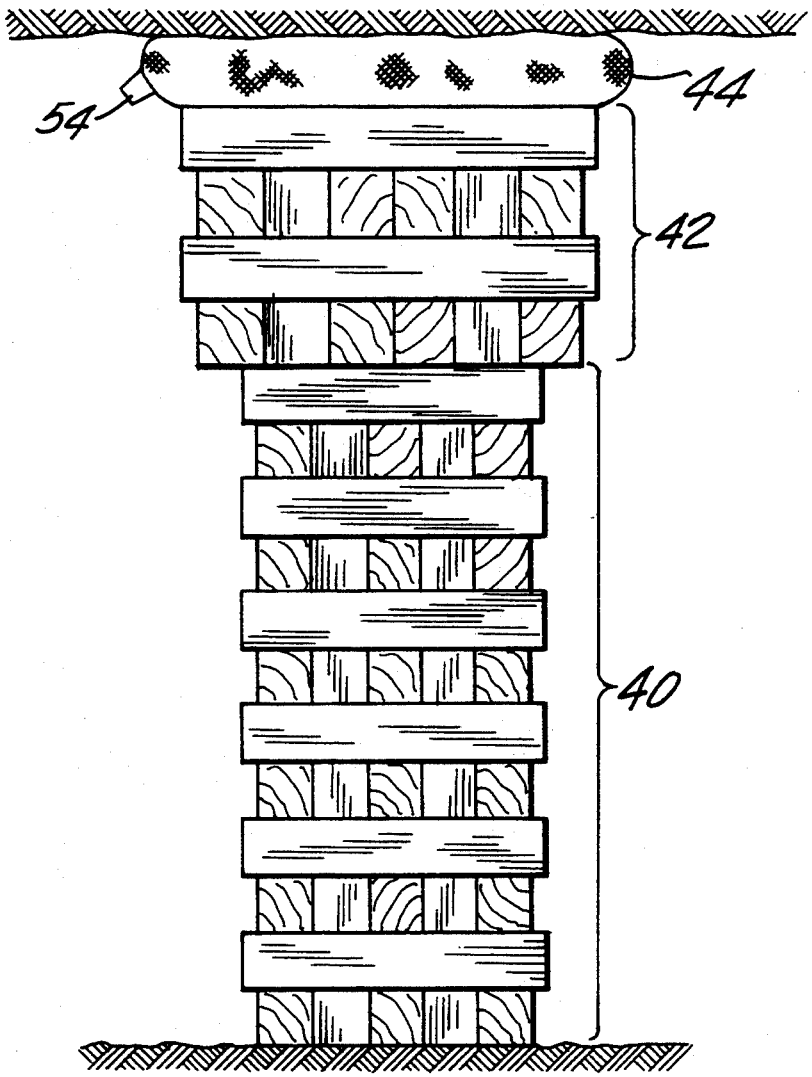
FIG. 4 shows a side elevation of a further embodiment of the invention.

FIG. 4 of the drawings illustrates a further embodiment of the invention. As before, this embodiment has a relatively stiff spacer, indicated by the numeral 40, a yielding pack 42 on top of the spacer 40, and a grout-inflatable PACKSETTER bag 44 on top of the pack 42.

In the embodiment of FIG. 4, the stiff spacer 40 is itself provided by timber-based pack layers or mats, typically in a HERCULES type configuration.

Figure 6:
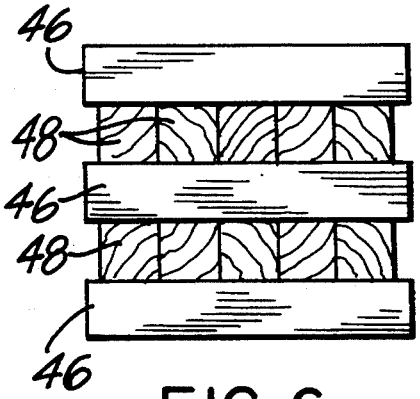
FIG. 6 shows a plan view of a pack layer in the relatively stiff spacer of FIG. 4.

Referring to FIG. 6 there is illustrated one pack layer used in the stiff spacer 40. The illustrated layer is of generally square proportions, with three elongate timber slabs 46 spaced apart from one another by timber blocks 48. The timber grain of the slabs 46 extends lengthways, but the timber grain in the case of the blocks 48 is vertical, i.e. these blocks have a so-called end-grain configuration.

Layers of the type seen in FIG. 6 are laid one on top of the other to form the full height of the spacer 40. Each layer is turned through 90° with respect to the layer immediately beneath it. Given the layout of the blocks 48 in FIG. 6, it will be appreciated that some of these blocks will, in the assembled spacer 40, bear directly on blocks beneath them, in effect creating "columns" of blocks with their timber grain orientated vertically. The presence of these "columns" of end-grain timber render the spacer 40 extremely stiff and resistant to vertically applied loading.

Figure 5:
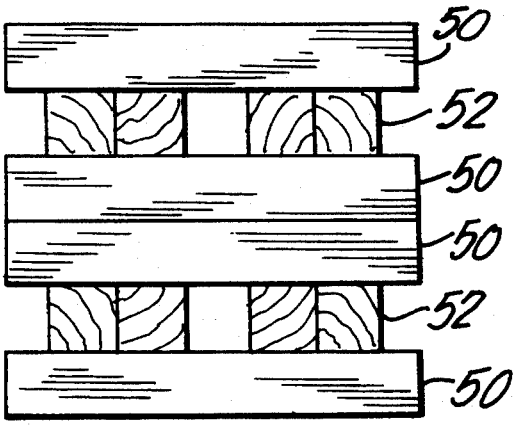
FIG. 5 shows a plan view of a pack layer in the yielding timber pack of FIG. 4.

FIG. 5 illustrates a typical layer or mat used in the yielding pack 42 located on top of the spacer 40. This layer also employs elongate slabs 50 with their timber grain extending lengthways, and intermediate end-grain blocks 52 with a vertical grain orientation. As in the case of the spacer 40, alternate layers in the pack 42 are turned through 90° relative to the layer immediately below. From the geometry of the layer seen in FIG. 5, it will be appreciated that there is less direct block-on-block contact than in the spacer layers described in relation to FIG. 6. In the result, the pack 42 is less stiff in a vertical sense than the spacer 40. In use, closure of the hanging wall on the footwall is accommodated by yielding in the pack 42.

As in the earlier embodiments, a grout-inflatable bag is placed on top of the yielding pack 42 and is inflated with a suitable settable substance through a nozzle 54. The bag expands as it fills with the substance, and comes into firm contact with the hanging wall 56. The grout is pumped into the bag 44 under considerable pressure, with the result that the entire support assembly is subjected to a vertical prestressing force. The initial prestress places the assembly in a condition ready to accept vertical loading from the hanging wall.

The grout which is pumped into the grout bag may be one which is itself designed to yield under the loads imposed by the hanging wall closing on the footwall. In such a case, the necessary yielding is therefore taken up both by the grout and by the pack 42. As yet another alternative, the arrangement could be such that the grout alone provides the yielding function.

As in the earlier embodiments, the spacer 40 serves as a stiff support for the yielding components, and raises those components to an appropriate elevation for engagement with the hanging wall. As described previously, this leads to the advantageous situation that a safe slenderness ratio for the yielding pack 42 can be provided.

We claim:

1. A method of providing yielding support for a hanging wall above a footwall in a mine working, the method comprising the steps of:

installing, between the hanging and footwalls, a support assembly which includes:

a spacer comprising an assembly of timber members arranged in relation to one another to produce a structure with a relatively high level of stiffness in the vertical direction, and a pack mounted upon or beneath the spacer, the pack comprising elongate timber members arranged in a plurality of superimposed layers with the member members in one layer at right angles to the timber members in the adjacent layers, the pack having a relatively low level of stiffness in the vertical direction and being vertically yieldable under compressive loading applied thereto when the hanging wall closes towards the footwall in the mine working;

locating between the support assembly and the hanging wall or footwall, a bag which is inflatable with grout; and inflating the bag with grout so that the bag expands into contact with the handing wall or footwall and places the support assembly under vertical preload.

2. A method according to claim 1 wherein a series of elongate timber members is arranged side-by-side in a cluster, with the timber grain of the timber members extending in a direction transverse to the hanging wall and the footwall, thereby to form the spacer.

3. A method according to claim 1 wherein the spacer is formed by laying a series of layers one on top of the other, each layer including a plurality of elongate timber members arranged with their timber grain horizontal and a plurality of timber blocks arranged with their timber grain vertical, the arrangement of layers one on top of the other being such that at least some of the timber blocks bear directly on timber blocks of the layer immediately below.

4. A support assembly for supporting a hanging wall in yieldable fashion above a footwall in a mine working, the support assembly comprising:

a spacer comprising an assembly of timber members arranged in relation to one another to produce a structure with a relatively high level of stiffness in the vertical direction, a pack mounted upon or beneath the spacer, the pack comprising elongate timber members arranged in a plurality of superimposed layers With the timber members in one layer at right angles to the timber members in the adjacent layers, the pack having a relatively low level of stiffness in the vertical direction and being vertically yieldable under compressive loading applied thereto when the hanging wall closes towards the footwall in the mine working, the spacer and pack forming a support assembly; and a bag which is locatable between the support assembly and the hanging wall or the footwall and which is inflatable with grout that expands the bag into contact with the hanging wall or the footwall and places the support assembly under vertical preload.

5. A support assembly according to claim 4 wherein the spacer comprises a series of interconnected elongate timber members with their timber grain extending in a direction transverse to the hanging wall and the footwall.

6. A support assembly according to claim 5 wherein the timber members are in the form of slabs machined to have a rectangular cross-section, the slabs being connected directly to one another in side-by-side relationship.

7. A support assembly according to claim 5 wherein the timber members are in the form of slabs machined to have a rectangular cross-section, the slabs being connected to one another with timber spacer blocks between them.

8. A support assembly according to claim 4 wherein the spacer comprises a series of layers placed one on top of the other, each layer comprising a plurality of elongate timber members arranged with their timber grain horizontal and a plurality of timber blocks arranged with their timber grain vertical, the arrangement of layers one on top of the other being such that at least some of the timber blocks bear directly on timber blocks of the layer immediately below.

* * * * *

UNITED STATES PATENT AND TRADEMARK OFFICE

CERTIFICATE OF CORRECTION

PATENT NO. : 5,435,670
DATED : July 25, 1995
INVENTOR(S) : Pienaar et al

It is certified that error appears in the above-indentified patent and that said Letters Patent is hereby corrected as shown below:

Column 5, claim 1, line 12, change "member" to --timber --.

Signed and Sealed this

Twenty-fourth Day of October, 1995

*Attest:*

*Attesting Officer*

BRUCE LEHMAN

*Commissioner of Patents and Trademarks*